US005647422A

United States Patent [19]

Weng

[11] Patent Number: 5,647,422

[45] Date of Patent: Jul. 15, 1997

[54] VERTICAL BLIND ASSEMBLY

[76] Inventor: Ming Lu Weng, P.O. Box 63-99, Taichung, Taiwan

[21] Appl. No.: 666,612

[22] Filed: Jun. 18, 1996

[51] Int. Cl.[6] ..... E06B 9/26

[52] U.S. Cl. ..... 160/176.1; 160/900

[58] Field of Search ..... 160/168.1 V, 172 V, 160/173 V, 176.1 V, 177 V, 178.1 V, 900

[56] References Cited

U.S. PATENT DOCUMENTS 4,214,622 7/1980 Debs ..... 160/168.1 V
4,291,738 9/1981 Grenga et al. ..... 160/172 V X
4,316,493 2/1982 Arena ..... 160/900 X
5,168,913 12/1992 Haines ..... 160/900 X
5,577,542 11/1996 Hung ..... 160/900 X

*Primary Examiner*—David M. Purol

[57] ABSTRACT

A vertical blind assembly includes two housings secured together so as to form a carrier frame. Two worm gears are rotatably received in the housings and engaged with each other. A post is coupled to one of the worm gears for rotating the worm gear. A beam is slidably engaged in the other gear so as to be rotated by the post. A number of casings each includes a gear slidably engaged on the beam and each includes a pole rotated by the gear and for supporting slats. The casings are secured to the housings by a number of couplers which may be easily disengaged from the housings.

4 Claims, 5 Drawing Sheets

VERTICAL BLIND ASSEMBLY

BACKGROUND OF THE INVENTION

1. Field of the Invention

The present invention relates to a vertical blind, and more particularly to a vertical blind assembly.

2. Description of the Prior Art

A typical vertical blind assembly is disclosed in U.S. Pat. No. 4,848,435 to Helver and comprise a carrier assembly having an integral carrier frame for receiving a number of gears and-a worm gear therein. The carrier assembly includes a complicated configuration such that the gears and the worm gear may not be easily engaged in the carrier frame.

The present invention has arisen to mitigate and/or obviate the afore-described disadvantages of the conventional vertical blind assemblies.

SUMMARY OF THE INVENTION

The primary objective of the present invention is to provide a vertical blind assembly which includes a simplified configuration that is excellent for assembling purposes.

The other objective of the present invention is to provide a vertical blind assembly which includes a casing that may be easily engaged with and disengaged from the carrier frame.

In accordance with one aspect of the invention, there is provided a vertical blind assembly comprising a first housing and a second housing secured together so as to form a carrier frame, the first and the second housings each including a room formed therein and each including a vertical opening formed therein and each including a lateral opening formed therein, the first and the second housings each including a vertical slot formed therein and each including at least one wheel rotatably secured thereto, a rod rotatably received in the vertical openings of the first and the second housings and including a first worm gear formed thereon and rotatably received in the rooms of the first and the second housings, a shaft rotatably received in the lateral openings of the first and the second housings and including a second worm gear formed thereon and rotatably received in the rooms of the first and the second housings for engaging with the first worm gear, the shaft including an engaging channel formed therein, a post coupled to the rod for rotating the rod and the first and the second worm gears, a beam engaged in the engaging channel of the shaft and arranged for allowing the shaft to be slidably engaged on the beam and for allowing the shaft and the beam to be rotated in concert with each other, a plurality of casings each including a pole rotatably supported therein for engaging with and for supporting a vertically oriented slat, the pole including a third gear provided on top thereof and rotatably received in the casing, a plurality of barrels each being laterally and rotatably supported in the casing and each including an outer peripheral portion having a fourth gear provided thereon for engaging with the third gear and for rotating the pole, the barrel being slidably engaged on the beam and rotated in concert with the beam, and a plurality of couplers each including a lower portion having a ring provided thereon for engaging with the pole and each including an upper portion having a catch provided thereon for engaging with the casing so as to secure the coupler to the casing, the couplers each including an engaging member for engaging with the slot of the first and the second housings so as to couple the casing to the first and the second housings. The first worm gear is rotated by the post in order to rotate the second worm gear and the beam and the fourth gear and the third gear, so as to rotate the pole and the slat.

The second housing includes at least one engaging hole formed therein, the first housing includes at least one hook for engaging with the engaging hole of the second housing so as to secure the first and the second housings together.

The shaft includes a plurality of spaced ribs formed therein so as to engage with the beam and so as to allow the shaft and the beam to be rotated in concert with each other.

The barrel includes a plurality of flanges formed therein for engaging with the beam so as to allow the barrel and the beam to be rotated in concert with each other.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 7:
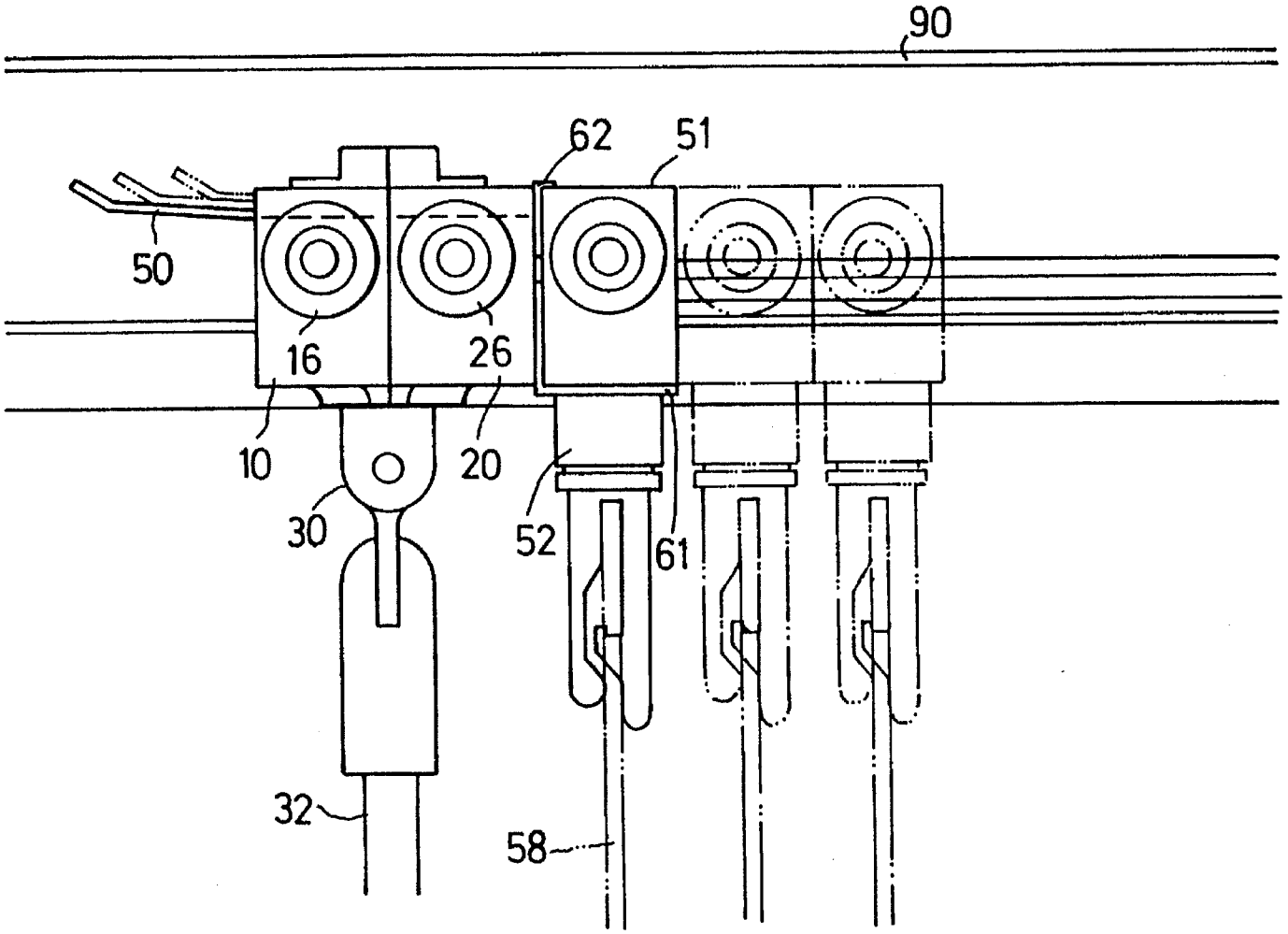
FIG. 7 is a schematic view illustrating the operation of the vertical blind assembly.

Referring to the drawings, and initially to FIGS. 1 to 4, a vertical blind assembly in accordance with the present invention comprises a carrier frame including a first housing 10 and a second housing 20 which are secured together so as to form the carrier frame. The housings 10, 20 each includes a room 11, 21 formed therein for receiving two worm gears 31, 41 therein. The housings 10, 20 each includes a vertical opening 12, 22 for rotatably receiving a rod 30 therein and each includes a lateral opening 13, 23 formed therein for rotatably receiving a shaft 40 therein. The worm gears 31, 41 are formed on the rod 30 and the shaft 40 respectively. A post 32 is coupled to the rod 30 for rotating the rod 30. The housings 10, 20 each includes a T-shaped slot 14, 24 vertically formed therein and each includes two spindles 15, 25 provided of the outer portion for supporting wheels 16, 26 thereon which are engaged in the typical track 90 of the vertical blind (FIG. 7). The housings 10, 20 each includes a recess 17, 27 formed therein for slidably receiving a spacer strip 50 therein. The housing includes a number of hooks 18, 19 for engaging with the engaging holes 28, 29 of the other housing 20 so as to secure the housings 10, 20 together. The shaft 40 includes an engaging channel 42 formed therein and defined by a number of spaced ribs 43 so as to engage with a cross shaped beam 44.

A number of casings 51 each includes a pole 52 rotatably supported therein for engaging with and for supporting a vertically oriented slat or lower 58. The pole 52 includes a gear 53 provided on top thereof and rotatably received in the casing 51. A barrel 54 is laterally and rotatably supported in the casing 51 and includes a gear 55 provided on the outer peripheral portion thereof for engaging with the gear 53 and for rotating the pole 52. The barrel 54 includes a number of flanges 56 formed therein (FIG. 2) for engaging with the beam 44 such that the barrel 54 may be rotated by the beam 44.

Figure 1:
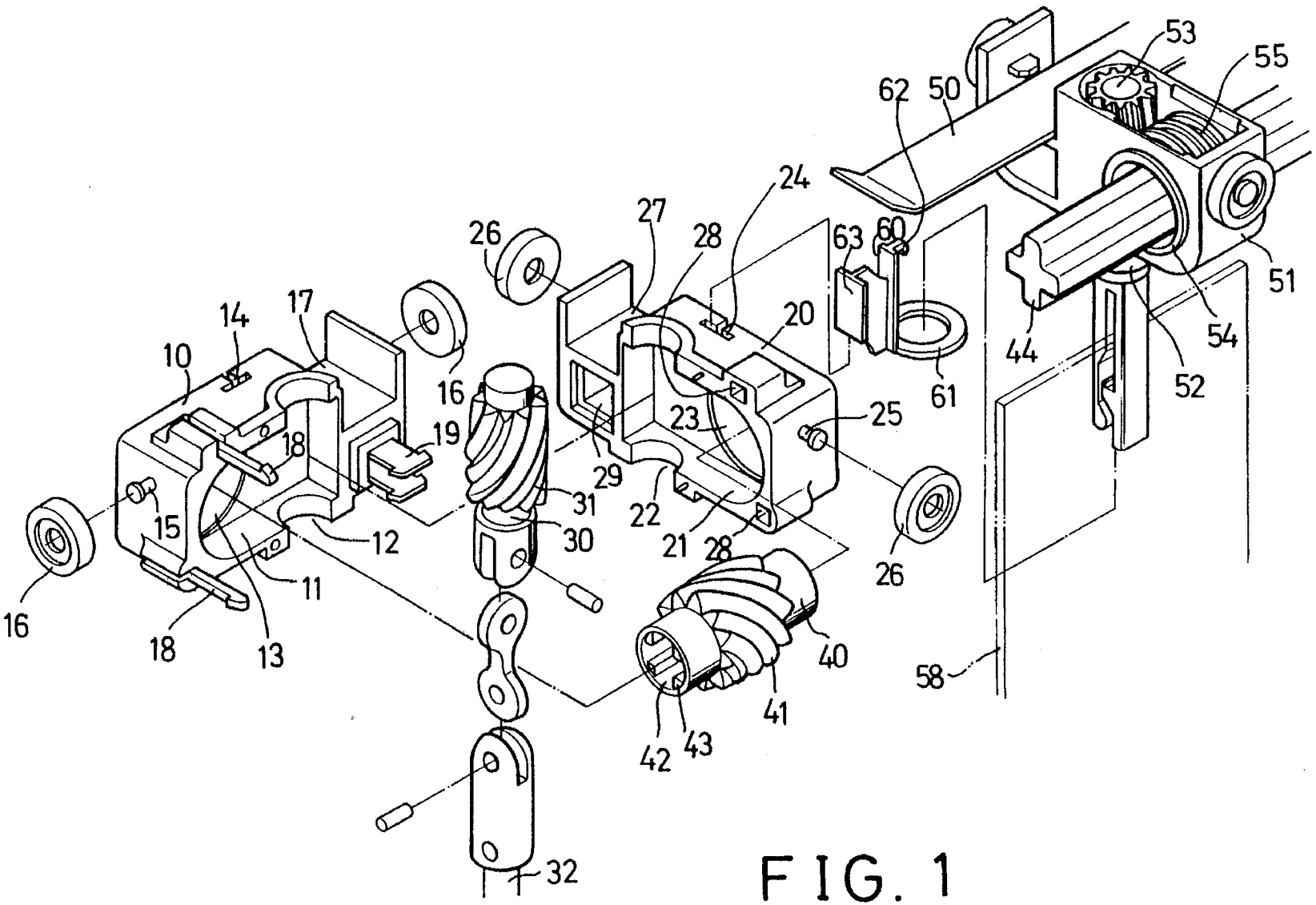
FIG. 1 is an exploded view of a vertical blind assembly in accordance with the present invention.
Figure 2:
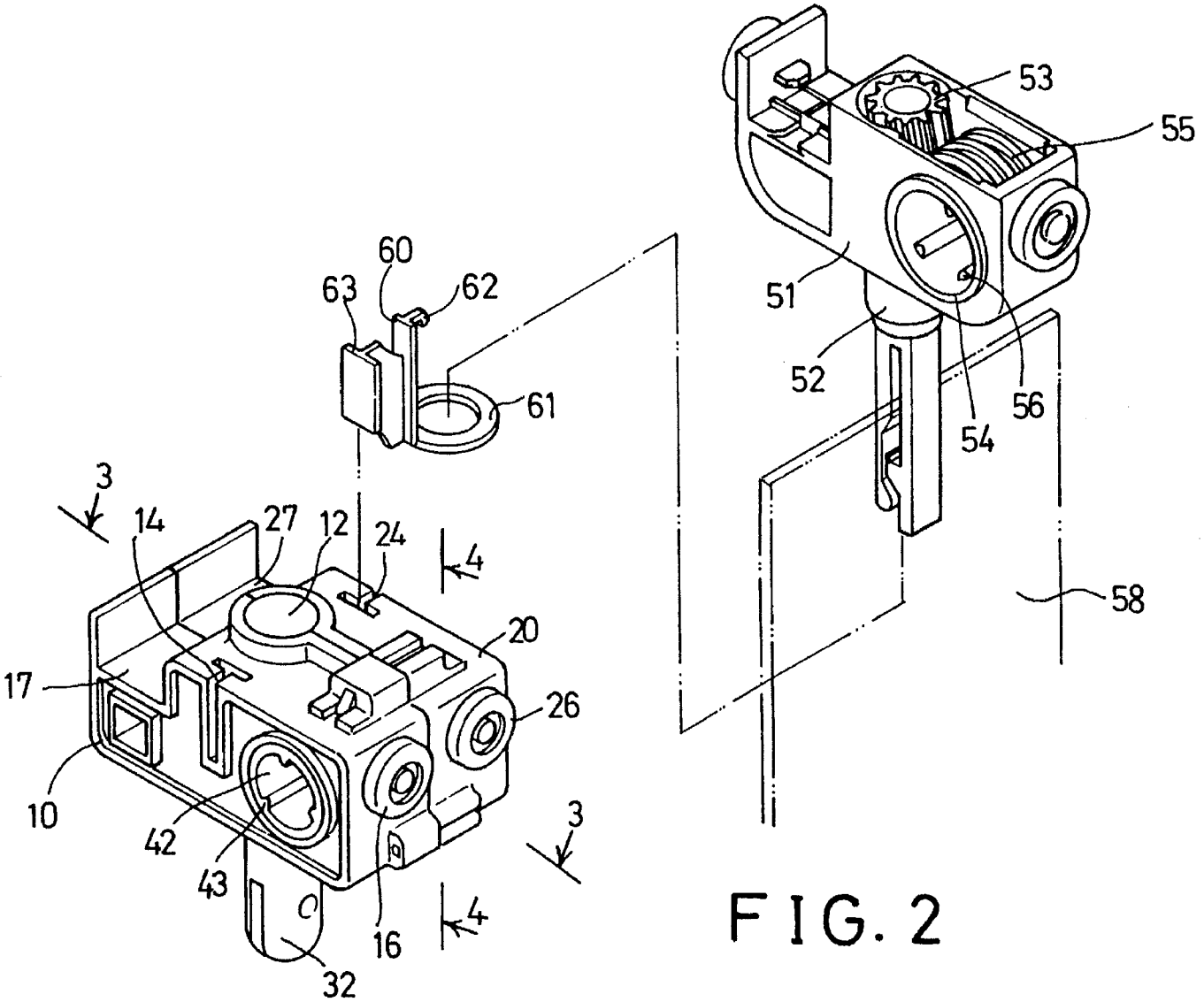
FIG. 2 is a partial exploded view of the vertical blind assembly.
Figure 3:
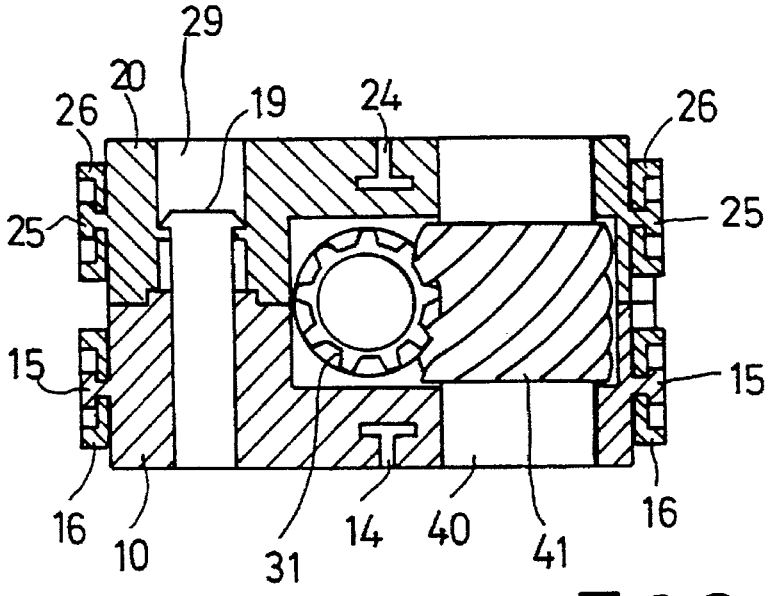
FIG. 3 is a cross sectional view taken along lines 3—3 of FIG. 2.
Figure 4:
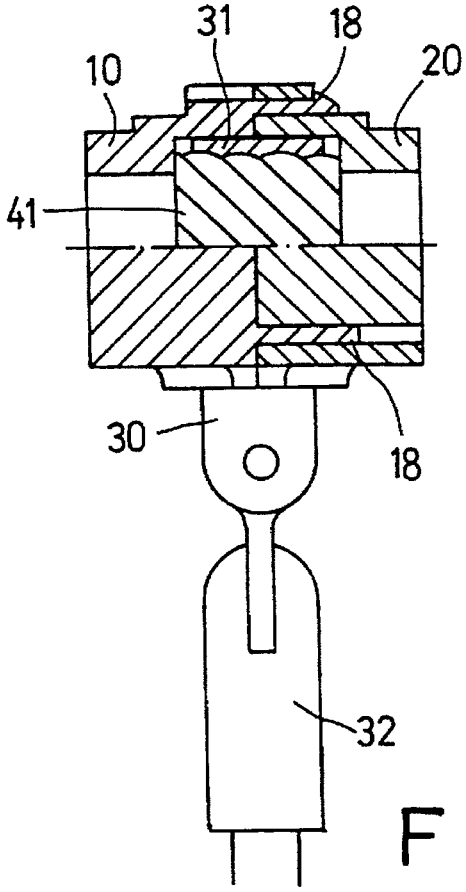
FIG. 4 is a cross sectional view taken along lines 4—4 of FIG. 2.
Figure 5:
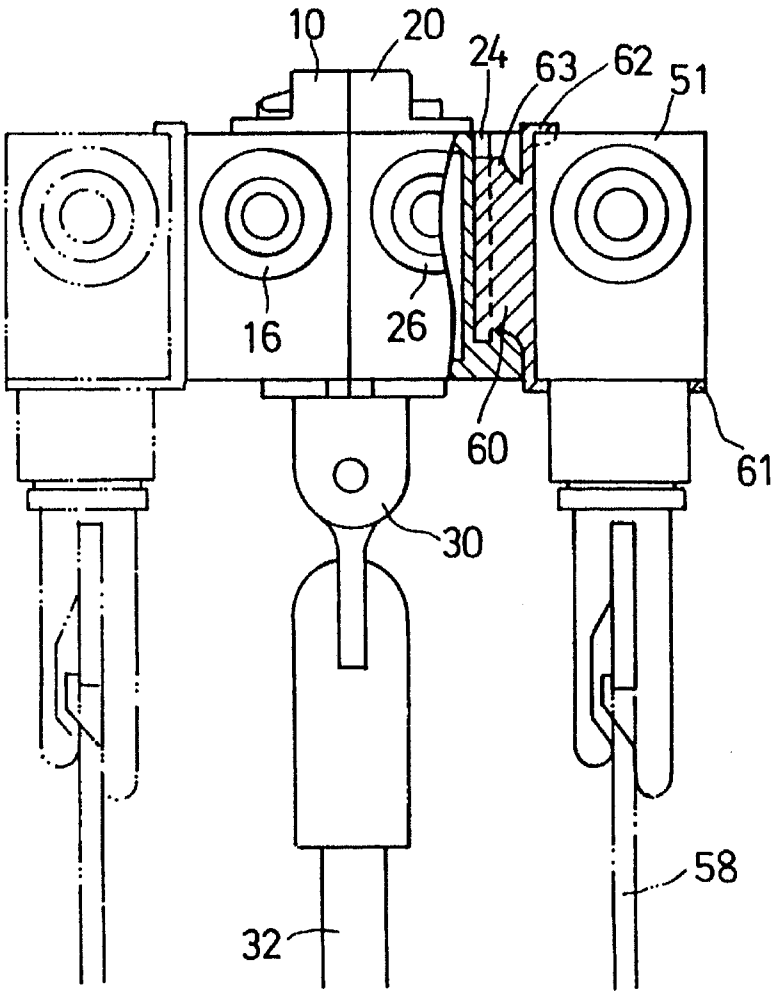
FIG. 5 is a plane view illustrating the coupling of the casing to the carrier frame.
Figure 6:
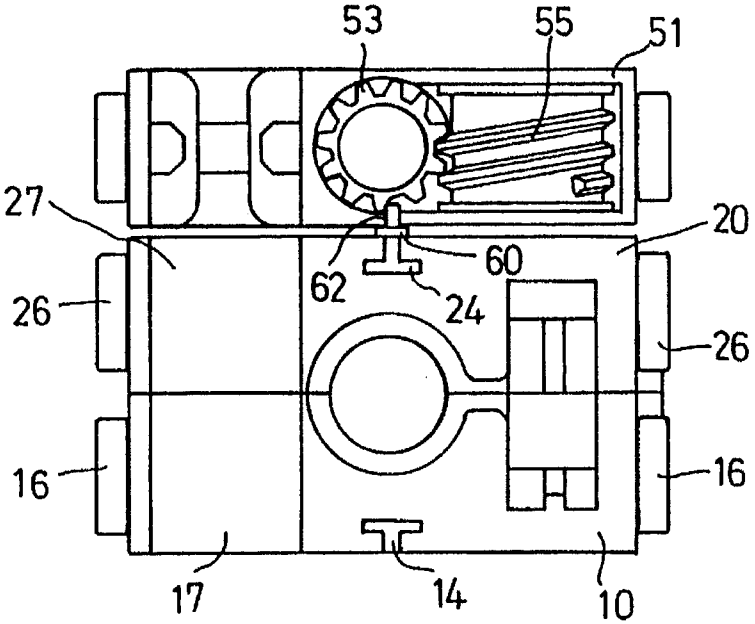
FIG. 6 is a top view of the vertical blind assembly.

As best show in FIGS. 5 to 7, a number of couplers 60 each includes a ring 61 provided in the lower portion for engaging with the pole 52 of the casing 51 and each includes a catch 62 provided on top thereof for engaging with the upper portion of the casing 51 such that the couplers 60 may be easily secured to the casing 51. The couplers 60 each includes a T-shaped engaging member 63 for engaging with the T-shaped slot 14, 24 of the housings 10, 20 such that the casings 51 may be easily coupled to the housings 10, 20.

In operation, the worm gear 41 may be rotated by the post 32 via the worm gear 31, such that the beam 44 and the barrel 54 and the gear 55 may also be rotated by the shaft 40. The pole 52 and the slat 58 may thus be rotated by the engagement of the gears 53, 55. As shown in FIG. 7, the housings 10, 20 and the casing 51 may be pulled and caused to move along the track 90 by the post 32.

It is to be noted that the casing 51 may be easily coupled to the housings 10, 20 by the coupler 60 and may be easily disengaged from the housings for repairing purposes. It is further to be noted that the end portions of the shaft 40 can be easily and stably engaged in the lateral openings 13, 23 of the housings 10, 20 when the housings 10, 20 are secured together. The vertical blind assembly includes a simplified configuration that is excellent for assembling purposes.

Accordingly, the vertical blind assembly in accordance with the present invention includes a simplified configuration for facilitating assembling operations of the vertical blind assembly and includes a casing that may be easily secured to the housings for repairing purposes.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A vertical blind assembly comprising:

a first housing and a second housing secured together so as to form a carrier frame, said first and said second housings each including a room formed therein and each including a vertical opening formed therein and each including a lateral opening formed therein, said first and said second housings each including a vertical slot formed therein and each including at least one wheel rotatably secured thereto, a rod rotatably received in said vertical openings of said first and said second housings and including a first worm gear formed thereon and rotatably received in said rooms of said first and said second housings, a shaft rotatably received in said lateral openings of said first and said second housings and including a second worm gear formed thereon and rotatably received in said rooms of said first and said second housings for engaging with said first worm gear, said shaft including an engaging channel formed therein, a post coupled to said rod for rotating said rod and said first and said second worm gears, a beam engaged in said engaging channel of said shaft and arranged for allowing said shaft to be slidably engaged on said beam and for allowing said shaft and said beam to be rotated in concert with each other, a plurality of casings each including a pole rotatably supported therein for engaging with and for supporting a vertically oriented slat, said pole including a third gear provided on top thereof and rotatably received in said casing, a plurality of barrels each being laterally and rotatably supported in said casing and each including an outer peripheral portion having a fourth gear provided thereon for engaging with said third gear and for rotating said pole, said barrel being slidably engaged on said beam and rotated in concert with said beam, and a plurality of couplers each including a lower portion having a ring provided thereon for engaging with said pole and each including an upper portion having a catch provided thereon for engaging with said casing so as to secure said coupler to said casing, said couplers each including an engaging member for engaging with said slot of said first and said second housings so as to couple said casing to said first and said second housings, said first worm gear being rotated by said post in order to rotate said second worm gear and said beam and said fourth gear and said third gear, so as to rotate said pole and said slat.

2. A vertical blind assembly according to claim 1, wherein said second housing includes at least one engaging hole formed therein, said first housing includes at least one hook for engaging with said engaging hole of said second housing so as to secure said first and said second housings together.

3. A vertical blind assembly according to claim 1, wherein said shaft includes a plurality of spaced ribs formed therein so as to engage with said beam and so as to allow said shaft and said beam to be rotated in concert with each other.

4. A vertical blind assembly according to claim 1, wherein said barrel includes a plurality of flanges formed therein for engaging with said beam so as to allow said barrel and said beam to be rotated in concert with each other.

* * * * *